United States Patent [19]

Alfors

[11] Patent Number: 4,641,003

[45] Date of Patent: Feb. 3, 1987

[54] LEVER OPERATED SWITCH WITH IMPROVED LEVER INTERCHANGEABILITY

[75] Inventor: Eugene D. Alfors, Rockford, Ill.

[73] Assignee: Honeywell Inc., Minneapolis, Minn.

[21] Appl. No.: 669,184

[22] Filed: Nov. 6, 1984

[51] Int. Cl.[4] ..... H01H 3/20

[52] U.S. Cl. ..... 200/332; 200/153 T

[58] Field of Search ..... 200/329–332, 200/334–338, 340, 153 T, 153 G, 153 H, 293

[56] References Cited

U.S. PATENT DOCUMENTS

| | | | |
|---|---|---|---|
| 3,040,152 | 6/1962 | Besemer | 200/332 |
| 3,336,458 | 8/1967 | Hadley | 200/332 |
| 3,681,554 | 8/1972 | Arthur | 200/332 |
| 3,700,843 | 10/1972 | Resh | 200/332 |
| 4,072,841 | 2/1978 | Corfield | 200/332 |
| 4,306,132 | 12/1981 | Henville | 200/332 |
| 4,429,200 | 1/1984 | Glenn et al. | 200/153 T |

*Primary Examiner*—Stephen Marcus
*Assistant Examiner*—Linda J. Sholl
*Attorney, Agent, or Firm*—Charles L. Rubow

[57] ABSTRACT

A lever operated device having an interchangable lever mounting feature is disclosed in which a body or housing is formed with a cylindrical cavity which holds a retainer configured with a recess to receive a lateral pivot portion of an operator lever. The lever is held captive with the pivot portion thereof confined to the recess in the retainer by a bounding surface of the cavity when the retainer is in place.

17 Claims, 6 Drawing Figures

LEVER OPERATED SWITCH WITH IMPROVED LEVER INTERCHANGEABILITY

BACKGROUND OF THE INVENTION

The invention disclosed herein relates generally to arrangements for pivotally mounting levers in lever operated mechanisms, and more particularly to a lever mounting arrangement for facilitating lever interchangeability in plunger actuated electrical switches.

Lever operated electrical switches are used in a wide variety of applications. The same electrical switch mechanism may be used in applications requiring a large number of different operating levers. Electrical switches of the same design may, in fact, be fitted with any of several hundred different operating levers depending on the requirements of the applications in which they are to be used. In order to avoid the need for maintaining a stock of complete switch/lever assemblies having all lever configurations, various designs are known to permit an appropriate operating lever to be installed in the field as the need for a switch with a particular lever configuration arises. It is also beneficial in many circumstances to be able to remove and/or interchange operating levers.

In general, the designs which are intended for installation of operating levers after manufacture of the switches fall into one of two categories. In one category, the lever or some portion thereof is resilient, thus permitting it to be snapped into place in or on some portion of the switch housing. In the other category, at least some portion of the switch housing is resilient, thus permitting pivot defining portions of the levers to be snapped past protrusions or into recesses in the switch housing.

The requirements presently placed on many switches are not well met by known switch designs in either of the above design categories. Some of the principal requirements include low cost, long life, low actuating force and actuating force which remains substantially constant throughout the operating life. Maximizing any one of these characteristics often involves comprises relating to one or more of the other characteristics. The maturation of technologies which permit very low force, long life electrical switching, such as Hall effect or other solid state switching where operating life capabilities and requirements may exceed 100,000,000 operating cycles, compound the problem of achieving a suitable mechanical actuator design. In designs in which the operating lever is required to bend during each operation, careful consideration must be given to stress and fatigue in the lever. To avoid stress and fatigue failures, it has been found desirable to utilize a pivoting rigid operating lever. Use of a rigid operating lever also facilitates comliance with vibration requirements and permits tight control over pivot axis location and lever positioning.

For purposes of reducing pivot point stress and wear which affect both operating life and consistency of operating force, it is necessary to have adequate bearing surface area. In known designs utilizing rigid levers and resilient plastic switch housings, bearing surface area is limited because the amount by which the housing can be deformed is small. Also, snapping the lever past projections in the housing can raise a burr which may adversely affect low force operation and/or operating life.

The geometry of the lever and plunger arrangement should also be such as to minimize side forces and sliding of the lever on the plunger. This requires that the pivot axis be located close as possible to the plane which is perpendicular to the direction of plunger movement at the point of contact between the lever and plunger.

Finally, with regard to lever interchangeability, prior designs are generally not intended for or suitable for removing or interchanging operating levers.

The applicant has provided a unique operator lever mounting arrangement with improved characteristics as to the noted requirements and desirable features by employing a rigid operator lever of simple configuration which is capable of simple, convenient and repetitive lever installation and removal.

SUMMARY OF THE INVENTION

The present invention is a lever operated device with a lever mounting arrangement which permits lever interchangeability, the device including a base or housing having a major surface thereon through which a plunger extends. A lever overlying the plunger is pivotally carried by a retainer which is removably held in a cavity in the base. The retainer is formed with a recess configured to receive a pivot portion of the lever which is held captive in the recess by a portion of the base which bounds the cavity. The cavity is of a generally cylindrical configuration and communicates with an opening in the major surface, the opening being partially closed by a closure portion of the retainer. The pivot portion of the lever may comprise a pair of oppositely extending projections which are received in a pair of recesses disposed on the side of the closure portion of the retainer away from the major surface of the base. The retainer and base may be configured with a detent to assist in maintaining the retainer in place, and the retainer may be configured to provide a stop which limits pivotal movement of the lever away from the base.

DESCRIPTION OF THE PREFERRED EMBODIMENT

Figure 1:
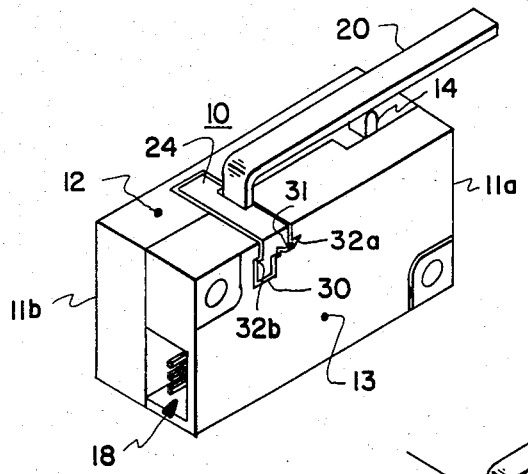
FIG. 1 is a perspective view of a preferred embodiment of a solid state electrical switch including the applicant's lever mounting arrangement.
Figure 3:
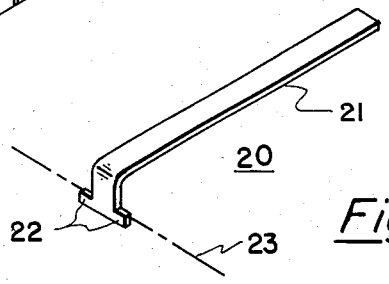
FIG. 3 is a perspective view of the operator lever utilized in the switch of FIGS. 1 and 2.
Figure 2:
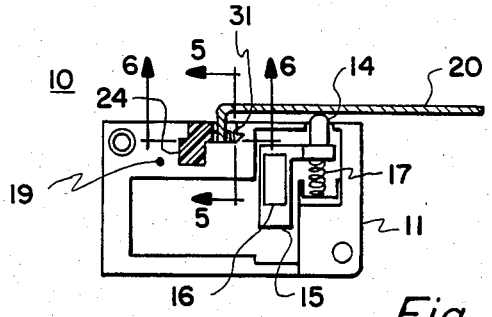
FIG. 2 is a longitudinal cross sectional view of the switch of FIG. 1.

In FIGS. 1 and 2, reference numeral 10 generally identifies a lever operated device, such as an electrical switch having a split housing 11*a* and 11*b* generally in the form of a rectangular polyhedron. Housing 11 has first and second adjacent walls with exterior surfaces 12 and 13 respectively and contains an electrical switching device which is actuated by a plunger 14 which extends through surface 12 and is adapted for reciprocal movement relative to housing 11. The wall corresponding to surface 12 is identified by reference numeral 19 in FIG. 2.

The switching device is a Hall effect switch including a stationary Hall element (not shown) and a moveable carrier 15 attached to plunger 14 carrying a magnet 16, whereby the magnet can be repositioned relative to the Hall element to effect switching. A coil spring 17 compressed between carrier 15 and a portion of housing 11 biases the plunger 14 and the attached carrier and magnet 16 upwardly as shown in FIG. 2. Electrical connections to the Hall element are made through a connector 18 shown in FIG. 1.

Plunger 14 is operated by a lever 20 having a shank portion 21 and a pivot portion shown in FIG. 2 as a pair of oppositely extending projections 22 which define a pivot axis 23. Projections 22 are held captive in housing 11 by means of a removable retainer 24 which is configured to fit snugly in a generally cylindrical cavity 30 at the intersection of surfaces 12 and 13 in housing 11. For purposes of describing and claiming the present invention, a cylinder is defined as any surface traced by a straight line moving parallel to a fixed straight line. Thus, cylindrical refers to any shape which has a constant cross section in parallel planes.

Figure 5:
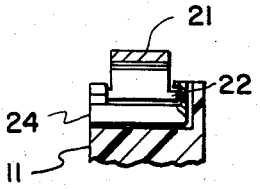
FIG. 5 is an enlarged partial cross sectional view of the switch of FIGS. 1 and 2 taken along lines 5—5 in FIG. 2.
Figure 6:
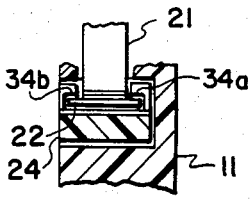
FIG. 6 is an enlarged partial cross sectional view of a switch of FIGS. 1 and 2 taken along lines 6—6 in FIG. 2.
Figure 4:
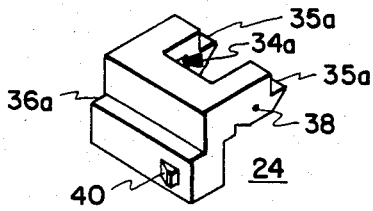
FIG. 4 is an enlarged perspective view of a lever retainer utilized in the switch of FIGS. 1 and 2.

Cavity 30 is partially bounded by a surface 31 in wall 19. Cavity 30 also includes undercut regions 32*a* and 32*b* in wall 19. As shown in FIG. 1, the opening in surface 12 is partially closed by means of a closure portion of insert 24 which will be described in greater detail in connection with FIGS. 4–6. Housing 11 and retainer 24 define an aperture in surface 12 through which shank 21 of lever 20 extends.

Retainer 24 is configured with portions 35*a* and 36*a* which mate with undercut regions 32*a* and 32*b* respectively in wall 19. Thus, these surfaces and undercut regions prevent removal of retainer 24 through the opening in surface 12.

A pair of recesses 34*a* and 34*b* are formed in retainer 24 in the side of the closure portion of the retainer opposite surface 12. Recesses 34*a* and 34*b* are configured to receive projections 22 on lever 20. Thus, lever 20 is held captive when insert 24 is in place because projections 22 are confined in recesses 34*a* and 34*b* by surface 31. Recesses 34*a* and 34*b* and projections 22 are sized and configured to permit limited pivotal movement of lever 20 about axis 23. The sizing and configuration is, however, designed to provide tight control over the pivot axis and lever position. Also, insert 24 is configured to provide a stop for limiting pivotal movement of lever 20 away from housing 11. Finally, the length of projections 22 is such that, as lever 20 is laterally displaced, the ends of the projections contact end walls 38 of retainer 24 before shank 21 contacts other retainer surfaces so as to insure low friction operation.

Retainer 24 is configured for a snug fit in cavity 30. Retention in the cavity is further insured by means of a projection 40 on the retainer which mates with an indentation in the housing so as to form a detent. However, retainer 24 may be slid from cavity 30 through surface 13 of housing 11 when desired so as to permit interchanging of operator levers.

Although a particular embodiment of the applicant's lever operated device with an interchangable lever mounting feature is shown and described for illustrative purposes, a number of variations and modifications will be apparent to those familiar with the relevant arts. It is intended that coverage of the invention not be limited to the embodiment shown, but only by the terms of the following claims.

The embodiments of the invention in which an exclusive property or right is claimed are defined as follows:

1. In a device of the type including a housing in which is mounted a mechanism actuated by a plunger extending through a wall of the housing and adapted for reciprocal movement, the plunger being operated in at least one direction by a lever having a laterally oriented pivot portion supported by the housing, the improvement which comprises a retainer adapted to be removably held in a cavity in the housing, said retainer and at least a portion of the bounding surface of the cavity cooperatively defining a recess configured to hold the pivot portion of the lever captive when said retainer is in place and to release the pivot portion of the lever for the recess when said retainer is removed.

2. The device of claim 1 wherein:

the pivot portion of the lever is in the form of a pair of oppositely extending projections at one end of the lever defining a pivot axis;

the recess is partially bounded by end walls of said retainer; and said retainer and said lever are configured such that lateral movement of said lever is limited by the ends of the projections coming into contact with the end walls bounding the recess.

3. The device of claim 2 wherein:

the housing is generally configured as a rectangular polyhedron of which a first exterior surface comprises a surface of the wall of the housing through which the plunger extends and a second adjacent exterior surface comprises the exterior surface of a second wall which intersects the first wall; and the cavity in the housing is located at the intersection of said first and second walls.

4. The device of claim 3 wherein:

the cavity in the housing is generally cylindrical in shape and communicates with an opening through said first wall, the cavity further including an undercut region in said first wall; and said retainer includes a portion which slides into the undercut region as said retainer is inserted into the cavity.

5. The device of claim 4 wherein:

the lever comprises a shank having said pair of oppositely extending projections at one end thereof;

said housing and said retainer define an aperture in said first surface through which the shank of said lever extends; and said retainer is configured to provide a stop which limits pivotal movement of said lever away from said housing.

6. The device of claim 5 wherein said retainer and said housing are configured to provide a detent which assists in maintaining said retainer in said housing.

7. A lever mounting arrangement for a lever operated mechanism comprising:

a base having a major surface and a cavity therein with an opening through the major surface;

a rigid lever overlying said base and having a laterally oriented portion which defines a pivot axis; and a retainer adapted to be removably held in the cavity in said base, and retainer having a recess therein configured to receive the laterally oriented portion of said lever, said lever being held captive in the recess by said base when said retainer is located in the cavity and freed from the recess when said retainer is removed from the cavity.

8. The mounting arrangement of claim 7 wherein:

the cavity in said base is of a generally cylindrical configuration extending parallel with the pivot axis of said lever and communicates with an opening in the major surface of said base;

the laterally oriented portion of said lever comprises a pair of oppositely extending lateral projections at one end thereof; and said retainer is configured for a snug fit in the cavity and includes a closure portion which partially closes the opening in the major surface of said base to provide an aperture through which said lever extends, but through which the end thereof having the projections cannot pass.

9. The mounting arrangement of claim 8 wherein:

said base has a further surface which is transverse to and intersects the major surface, the cavity being located at the intersection of the major and further surfaces;

said base is formed with an undercut region underlying the major surface; and said retainer includes a portion which slides into the undercut region as said retainer is inserted into the cavity to prevent removal of the retainer through the opening in the major surface.

10. The lever mounting arrangement of claim 9 wherein said retainer and said base are configured to provide a detent which assists in maintaining said retainer in said base.

11. The mounting arrangement of claim 10 wherein said retainer is configured to provide a stop which limits pivotal movement of said lever away from said base.

12. A lever operated electrical switch comprising:

a housing including first and second adjacent transverse walls each with an exterior surface thereon, said housing containing an electrical switch mechanism actuated by a plunger extending through the first wall, said housing further being configured with a substantially cylindrical cavity therein extending from the second wall and communicating with an opening in the first wall;

a rigid lever having a shank overlying the plunger and a pair of oppositely extending lateral projections at one end defining a pivot axis; and a removable retainer located in the cavity in said housing and configured for a snug fit therewithin, said retainer having a closure portion which partially closes the opening in the first wall of said housing, the closure portion being formed with a pair of recesses in the side of the closure portion remote from the exterior surface of the first wall, the recesses being configured to receive the lateral projections on said lever, the lateral projections being held captive in the recesses by a portion of the housing bounding the cavity therein.

13. The switch of claim 12 wherein:

the recesses in said retainer are bounded by end walls; and said retainer and said lever are configured such that lateral movement of said lever is limited by the ends of the projections coming into contact with the ends walls bounding the recesses.

14. The switch of claim 13 wherein:

said housing is generally configured as a rectangular polyhedron of which two adjacent surfaces form the exterior surfaces of said first and second walls; and the cavity in said housing is located at the intersection of said first and second walls.

15. The switch of claim 14 wherein the cavity in said housing includes an undercut region in said first wall; and said retainer includes a portion which slides into the undercut region as said retainer is inserted into the cavity to prevent removal of the retainer through the opening in said first wall.

16. The switch of claim 15 wherein said retainer and said housing are configured to provide a detent which assists in maintaining said retainer in said housing.

17. The switch of claim 16 wherein:

said housing and said retainer define an aperture in said first wall through which the shank of said lever extends; and said retainer is configured to provide a stop which limits pivotal movement of said lever away from said housing.

* * * * *

UNITED STATES PATENT AND TRADEMARK OFFICE

CERTIFICATE OF CORRECTION

PATENT NO. : 4,641,003

DATED : FEBRUARY 3, 1987

INVENTOR(S) : EUGENE D. ALFORS

It is certified that error appears in the above-identified patent and that said Letters Patent is hereby corrected as shown below:

Column 4, line 16, delete "for", insert --from--.

Column 4, line 64, delete "and", insert --said--.

Signed and Sealed this

Twenty-first Day of April, 1987

*Attest:*

DONALD J. QUIGG

*Attesting Officer*

*Commissioner of Patents and Trademarks*